US008177271B2

(12) United States Patent
Zats

(10) Patent No.: US 8,177,271 B2
(45) Date of Patent: May 15, 2012

(54) PORTABLE RETRIEVER AND METHOD FOR COLLECTING AND DISPENSING TENNIS BALLS

(75) Inventor: Aleksey Zats, Fair Lawn, NJ (US)

(73) Assignee: Aleksey Zats, Fair Lawn, NJ (US)

( * ) Notice: Subject to any disclaimer, the term of this patent is extended or adjusted under 35 U.S.C. 154(b) by 131 days.

(21) Appl. No.: 12/799,418

(22) Filed: Apr. 23, 2010

(65) Prior Publication Data

US 2011/0262259 A1 Oct. 27, 2011

(51) Int. Cl.
*A63B 47/02* (2006.01)

(52) U.S. Cl. ..... 294/19.2; 211/14; 211/184; 211/181.1

(58) Field of Classification Search ..... 294/19.2; 206/315.9, 315.1; 211/14, 184, 43, 51, 85.31, 211/133.5, 181.1; 43/58, 61, 64–67; 312/348.3; 220/486, 529, 530, 531, 541, 542, 544, 545, 220/548, 549, 550
See application file for complete search history.

(56) References Cited

U.S. PATENT DOCUMENTS

| | | | | |
|---|---|---|---|---|
| 3,371,950 | A | 3/1968 | Stap | |
| 3,820,836 | A | 6/1974 | Seewagen | |
| 3,902,749 | A | 9/1975 | Falitz | |
| 4,077,533 | A | 3/1978 | Meyer | |
| 4,252,490 | A | 2/1981 | Keller | |
| 4,318,654 | A | 3/1982 | Lee | |
| 4,412,697 | A | 11/1983 | Verde | |
| 4,735,544 | A | 4/1988 | Stotts | |
| 5,301,991 | A | 4/1994 | Chen et al. | |
| 5,464,262 | A | 11/1995 | Madrazo | |
| 5,507,541 | A * | 4/1996 | Chen et al. | 294/19.2 |
| 6,354,643 | B1 | 3/2002 | Podejko | |
| 6,460,710 | B1 * | 10/2002 | Dardashti | 211/184 |
| 6,494,340 | B1 * | 12/2002 | Joo | 220/485 |
| 6,926,328 | B2 * | 8/2005 | Hellerson | 294/19.2 |
| 7,214,018 | B2 * | 5/2007 | Lussier | 410/130 |
| 2009/0211146 | A1 * | 8/2009 | Radesky et al. | 43/61 |
| 2010/0193379 | A1 * | 8/2010 | Matthews | 206/216 |

* cited by examiner

*Primary Examiner* — Saul Rodriguez
*Assistant Examiner* — Stephen Vu

(57) ABSTRACT

An increased capacity portable retriever for collecting and dispensing tennis balls utilized on a flat surface comprising a horizontally elongated container having a front retrieving section with a top handle, a rear collecting section pivotably supported by two wheels coaxially mounted at a bottom wall and a front wall dispensing opening with a cover. The front retrieving section contains bottom parallel rods spaced from each other a distance smaller than the tennis ball diameter. The container has horizontal retrieving and vertical dispensing positions. The container includes a compartment capacity regulating element for dispensing balls individually. First method of retrieving, collecting and dispensing tennis balls includes repetitive transferring a substantial group of balls from the retrieving section towards the collecting section. Second method includes cyclical reducing the container compartment capacity correspondingly to a volume of balls group resided in the compartment after dispensing a comfortably reachable balls portion from the container.

9 Claims, 10 Drawing Sheets

PORTABLE RETRIEVER AND METHOD FOR COLLECTING AND DISPENSING TENNIS BALLS

FIELD OF THE INVENTION

This invention relates to portable devices and methods for efficient handling tennis balls during practice on tennis court.

BACKGROUND OF THE INVENTION

Tennis courts are relatively large. Tennis players and instructors are using ball retrievers and large number of tennis balls to minimize balls gathering time. Racquet Club's instructors utilize teaching carts which hold over three hundred tennis balls, ball machines carrying over two hundred tennis balls in one load and retrieving devises with over two hundred balls capacity to refill carts and ball machines. This equipment is efficient and convenient to use in Racquet Clubs, but bulky and unpopular for travelling with from site to site.

Portable metal wire baskets are used by instructors and tennis players practicing tennis on remote courts. Solid baskets with permanent handles and baskets with reversible handles are mostly used as portable devices for retrieving, collecting, dispensing tennis balls and for refilling ball machines.

Stap patented a basket with permanent handle in 1968, U.S. Pat. No. 3,371,950. He describes a tennis ball retriever and storage unit comprising an upright wire basket with a top dispensing opening, a handle mounted above the opening, a retrieving bottom grate including parallel rods spaced from each other a distance smaller than the tennis ball diameter, so as to define the space through which squeezed balls pushed against a tennis court flat surface enter and retain in the retriever. Retrieving method consists of placing the basket over a ball or a few balls, pushing it down and lifting the basket up with retrieved balls inside. Later pushed in through the bottom grate balls are moving previously retrieved balls up inside the basket. This sequence is repeated until the basket gets full.

A wire basket with permanent handle is easy to use and inexpensive to manufacture. It is light, relievable, does not require bending over during balls retrieving process and has small width and length. First balls portion retrieving procedure is effortless.

However, when considerable group of balls is collected in the basket with permanent handle, a push down force has to be raised. A compression of soft tennis balls is causing that need. Balls located at the basket bottom are deformed more then others by balls upper layers gravity and by side forces. Side forces appear as a result of an insertion retrieved balls in between balls resided at the basket bottom. Deformed balls internal pressure creates friction forces between balls inserted into the basket, between balls and basket walls. The coefficient of friction between tennis balls is relatively high, so distorted balls at the basket bottom grate are causing a significant resistance entering last balls into the basket. Commercially available the largest basket with permanent handle fits only eighty five balls. After retrieving balls a basket with permanent handle can be set on a tennis court surface for balls dispensing. A basket user has to stoop or to lift the basket for reaching tennis balls. A basket with permanent handle is inconvenient to use for dispensing purposes.

Seewagen and Markisz patented a basket with reversible handles in 1974, U.S. Pat. No. 3,820,836. They describe a tennis ball retrieval device with similar structure to the basket with permanent handle patented by Stap. This device retrieving bottom includes a yieldable under the pressure of the tennis ball flexible elements instantly returnable to normal position preventing the egress of the tennis ball from the receptacle. The device also comprises two reversible handles witch may have above the receptacle open top a carrying position or beneath the receptacle a supporting position.

Basket with reversible handles has all basket with permanent handle advantages plus balls dispensing procedure is convenient, because it may be placed above a tennis court surface on a suitable height for dispensing purposes. A user does not have to stoop or to lift basket for reaching tennis balls.

However, distorted balls at the basket bottom grate are causing a significant resistance for entering last balls into the basket with reversible handles also. Yieldable under the pressure of a tennis ball flexible elements reduce resistance for entering balls into the basket insignificantly. The largest commercially available wire basket with reversible handles fits one hundred forty balls and the most popular one fits only seventy five balls. Fully filled with balls wire baskets with reversible handles are relatively heavy to carry and to install in a dispensing position.

Madrazo patented a basket with reversible handles in 1995 U.S. Pat. No. 5,464,262. A ball retrieving and storage receptacle comprising a rectangular basket formed of pair of parallel tubular frame members connected together by parallel tubular members defining a bottom of the basket and spaces from each other by slightly less then the diameter of the ball. Basket has a top dispensing opening with a cover. Wheeled casters are provided along one side of the basket bottom. The bottom of a wheel of each caster has being disposed no lower than a plane passing through the bottom members of the frames. Basket includes a pair of U-shaped reversible handles. Each handle may pivot between first position above the basket and a second opposite position below the basket in which the basket is supported above a horizontal surface. When the basket is tilted onto the wheels of both casters, the basket may be pulled over a horizontal surface on the said wheels.

Madrazo's basket with reversible handles has an advantage in comparison with previously described devices. The filled with balls tilted basket with reversible handles is relatively easy to move around using casters.

But distorted balls at Madrazo's basket bottom are causing a significant resistance for entering last group of balls into a basket as well. In order to use casters, the basket has to be tilted to create a clearance between bottom frame and flat tennis court surface. When the basket is tilted, positioned above the basket reversible handles are leaning with the basket. User has to increase push down force to retrieve the last group of balls, because it's action line in not normal to a tennis court surface. In addition, filled Madrazo's basket is relatively heavy for setting up in a dispensing position.

Podejko patented a basket with reversible handles in 2002 U.S. Pat. No. 6,354,643. A tennis ball holder and retriever comprising swivel caster assemblies mounted to the corners of the basket with downwardly spring-based telescopic assemblies that position the basket above balls for a rolling movement.

Podejko's basket with reversible handles has all previously described devices advantages and, in addition, the fully filled with balls basket is relatively easy to move around without need of tilting.

On the other hand, distorted balls at the basket bottom grate are causing a significant resistance for entering last balls into the Podejko's basket also. Moreover, springs have to be stiff enough to keep the filled basket above a tennis court surface. It will require an additional push down force to overcome springs tension forces. Filled with balls Podejko's basket with reversible handles is relatively heavy to place in a dispensing position.

Racquet Club's instructors utilize rolling carts and rolling barrels as retrieving devices. These devices commonly utilize a handcart with ball retrieving mechanism and a rear handle. The user walks behind such a device and pushes it forward to retrieve and collect tennis balls. Some rolling carts and rolling barrels U.S. Pat. Nos. 4,077,533; 4,252,490; 4,318,654; 4,735,544; 3,902,749.

Rolling carts and rolling barrels are efficient devices. Most of them are capable to retrieve over two hundred balls at once.

However, they are larger, heavier, less reliable and more expensive then portable wire baskets.

SUMMARY OF THE INVENTION

Objects of the invention are:

a) to provide a portable tennis ball retriever which will be light, compact and capable of collecting over two hundred tennis balls in one load;

b) to provide a portable tennis ball retriever which will be easy to use, reliable and inexpensive to manufacture;

c) to provide a portable tennis ball retriever which will not require bending over and using an extensive muscular force during balls retrieving and dispensing processes;

d) to provide methods for efficient tennis balls handling with a portable tennis ball retriever.

In accordance with the present invention, a portable retriever for collecting and dispensing tennis balls utilized on a flat surface comprising a horizontally elongated container having a dispensing opening with a cover, a top handle, a retrieving bottom aperture including parallel rods spaced from each other a distance smaller than the tennis ball diameter, so as to define a space through which squeezed balls pushed against a flat surface enter and retain in the container, a front retrieving section, a rear collecting section and a pivotable support. The retrieving bottom aperture with the top handle located at the front retrieving section and the pivotable support located at the rear collecting section. Methods of retrieving, collecting and dispensing tennis balls will become apparent with consideration of the following description.

Reference Numerals in Drawings

| | | | | | |
|---|---|---|---|---|---|
| 20 | solid container | 46 | parallel rods | 70 | tension screw |
| 22 | body | 48 | spacing rod | 72 | grip rod |
| 24 | retrieving section | 50 | axle | 74 | inner grip rod |
| 26 | collecting section | 52 | wheel | 76 | partition |
| 28 | top handle | 54 | bottom wall | 78 | partition clamp |
| 30 | pivotable support | 56 | rear projection | 80 | left side wall rod |
| 32 | front wall | 58 | front projection | 82 | right side wall rod |
| 34 | front opening | 59 | front wall rod | 84 | boss |
| 36 | front cover | 60 | recessed handle | 86 | slot |
| 38 | rear wall | 62 | rear wall rod | 88 | gate |
| 40 | rear opening | 64 | bottom recessed handle | 90 | latch |
| 42 | rear cover | 66 | top wall rod | 92 | partition rod |
| 44 | bottom aperture | 68 | friction hinge | 94 | knob |
| 96 | stud | 126 | bottom aperture | 152 | top wall rod |
| 98 | plate | 128 | parallel rods | 154 | friction hinge |
| 100 | upper screw | 130 | spacing rod | 156 | tension screw |
| 102 | lower screw | 132 | axle | 158 | grip rod |
| 104 | telescopic container | 134 | wheel | 160 | inner grip rod |
| 106 | body | 136 | carriage | 162 | tube |
| 108 | hopper | 138 | carriage clamp | 164 | body clamp |
| 110 | stand | 140 | stand bottom rod | 166 | rear end |
| 112 | retrieving section | 142 | stand rear wall | 168 | stand top rod |
| 114 | collecting section | 144 | rear projection | 170 | front opening |
| 116 | top handle | 146 | front wall | 172 | hopper clamp |
| 118 | pivotable support | 148 | front projection | 174 | left side wall rod |
| 120 | dispensing opening | 149 | front wall rod | 176 | right side wall rod |
| 124 | snap-on cover | 150 | recessed handle | 178 | bottom rods |
| | | | | 180 | spring |
| | | | | 182 | tennis ball |

DESCRIPTION OF THE INVENTION

Figure 1:
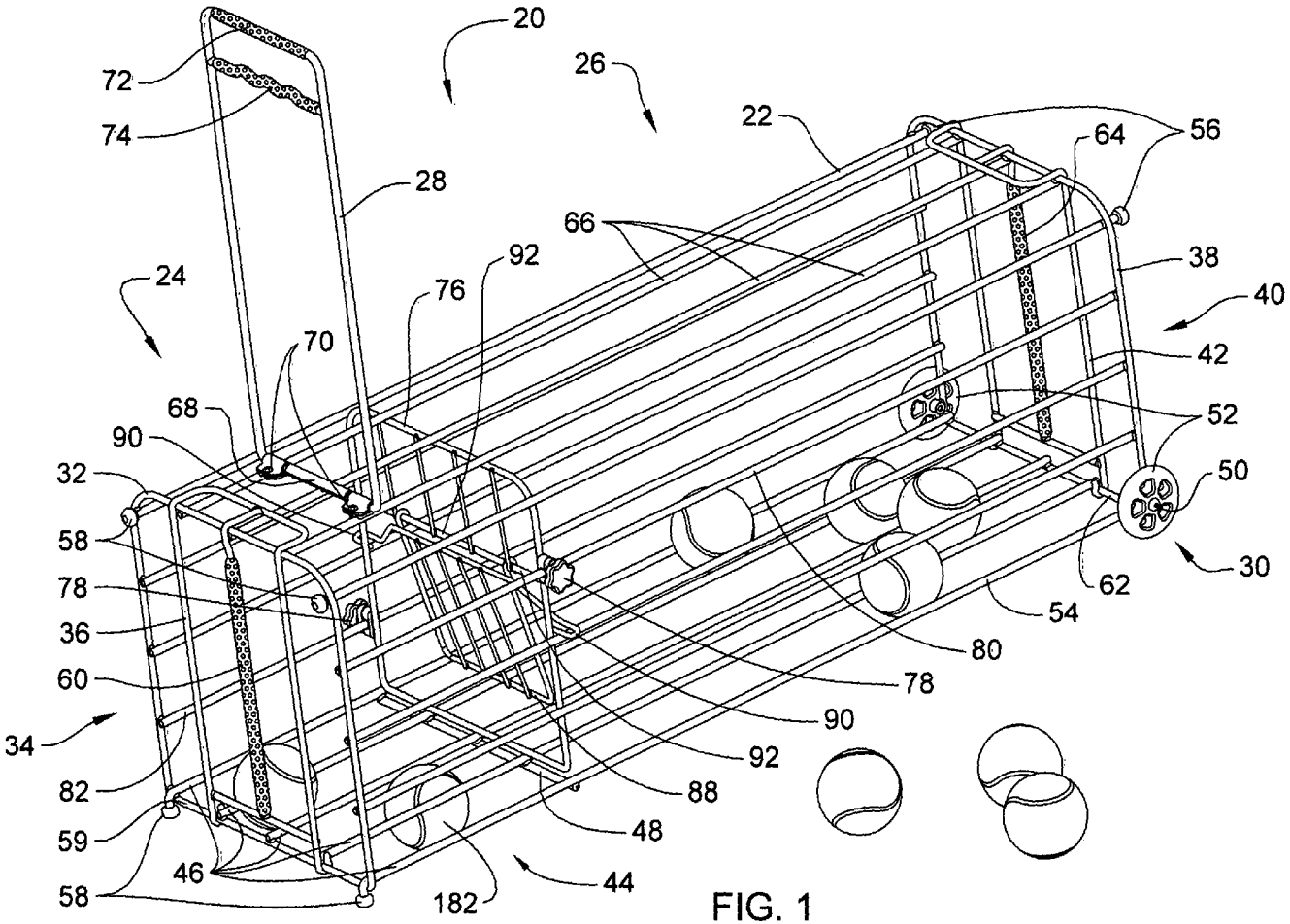
FIG. 1 is a perspective view of a solid retriever in a retrieving position.
Figure 2:
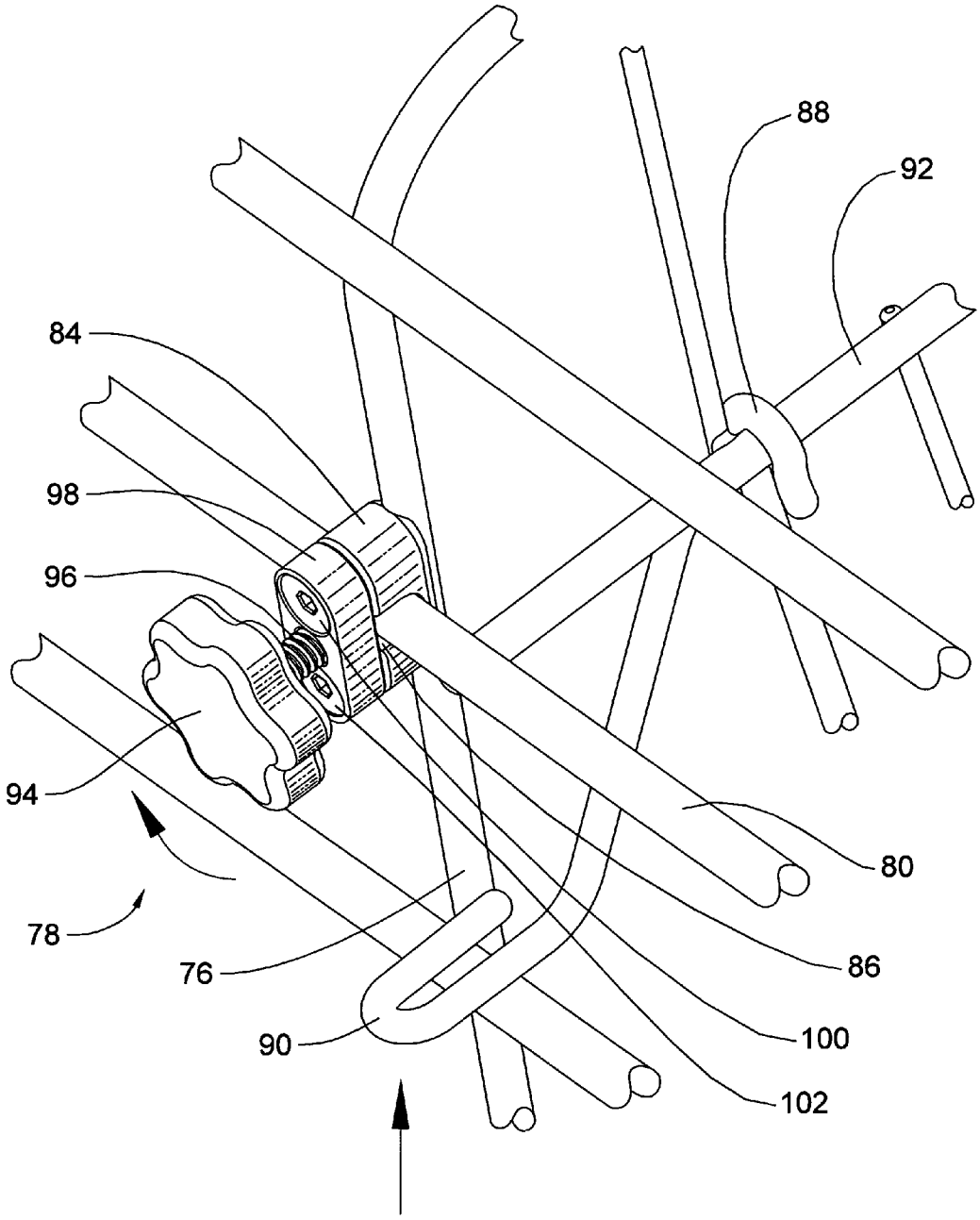
FIG. 2 is an enlarge fragmentary perspective view of a solid retriever clamp and gate latch.

A preferred embodiment of the portable retriever for collecting and dispensing tennis balls is shown in a retrieving position on FIG. 1. It comprises a horizontally extended solid container 20 mainly made from steel or stainless steel. The solid container 20 includes a welded wire basket type body 22 with a rectangular shape cross section. The solid container 20 has a front retrieving section 24, a rear collecting section 26, a top handle 28, a pivotable support 30, a front wall 32 rectangular shape dispensing opening 34 with a snap-on front cover 36 and a rear wall 38 rectangular shape dispensing opening 40 with a snap-on rear cover 42. The front retrieving section 24 contains a bottom aperture 44 including five parallel rods 46 spaced from each other a distance smaller than the tennis ball diameter, a spacing rod 48 and the top handle 28. The pivotable support 30 located at the rear collecting section 26 and includes two axles 50 and two wheels 52 coaxially mounted at a container bottom wall 54. Wheels 52 jut out from the bottom wall 54 and from the rear wall 38. The solid container 20 has an upright and an upside-down vertical dispensing positions. The rear wall 38 contains two rear projections 56 to set the container in the upright vertical dispensing position. The front wall comprises four front projections 58 for setting the container in the upside-down vertical dispensing position. The snap-on cover 36 is pivotably attached to a front wall bottom rod 59 and includes a middle recessed handle 60. The snap-on cover 42 is pivotably attached to the rear wall rod 62 and includes a middle bottom recessed handle 64. The top handle 28 pivotably attached to container top wall three rods 66 by a friction hinge 68 with two tension screws 70. The top handle 28 has two rubber coated parallel grip rods 72 and 74 and it is foldable. The solid container 20 has a partition 76 which by quick release rod partition clamps 78 slidably attached to body side walls rods 80 and 82. As shown in FIG. 2 the partition 76 includes two bosses 84 with slots 86 and a gate 88 with two latches 90. The gate 88 pivotably attached to a partition rod 92. The quick release rod partition clamp 78 comprises a knob 94 with a threaded stud 96 and a drilled and taped in the middle plate 98 attached to the partition boss 84 by two screws 100 and 102.

Shown in FIG. 1 the spacing rod 48 is preventing parallel rods 46 from an excessive deformation during a balls retrieving process. Snap-on covers 36 and 42 include rubber coated middle recessed handles 60 and 64 which can be utilized for moving the solid container 20 oriented vertically. The top handle 28 permits moving forward and backward the horizontally oriented solid container 20 plus turning it in horizontal and in vertical planes with one hand. Screws 70 can be turned to regulate friction hinge 68 necessary resistance to keep top handle 28 set in retrieving or in folded position. Two spread apart parallel grip rods 72 and 74 provide to the user a good handle control during retrieving process. Two knobs 94 are utilized to reposition the partition 76. It can be done by loosening them up, moving the partition to a desired position and retightening knobs 94. Shown on FIG. 2 the latch 90 consists of a flexible arm with a U-shaped end. To lock the gate 88, two U-shaped ends should be bended up, slightly turned as part of the gate 88 towards the partition 76 and released down to engage with a partition 76 frame vertical rods. To unlock the gate 88, two U-shaped ends should be pulled up, turned outwards the partition 76 and released down to disengage with the partition 76 frame vertical rods. The gate 88 is shown in FIG. 1 and FIG. 2 in an unlocked stage. In this instance, latches 90 function as the gate stoppers. At a beginning of a retrieving procedure, the partition 76 may be set at different locations and with the unlocked or locked gate 88. The partition location and the gate stage depend on number of balls to be retrieved and on a chosen technique. Most reasonable locations are next to the spacing rod 48 or at the container rear wall 38. Rear projections 56 and front projections 58 include rubber tips to protect a tennis court surface. The solid container 20 may be utilized without the partition 76 as a ball machine refilling device. In case a ball machine has to be refilled, balls may be discharged out from the solid container 20 by opening the snap-on cover 36 and tilting the container.

Figure 3:
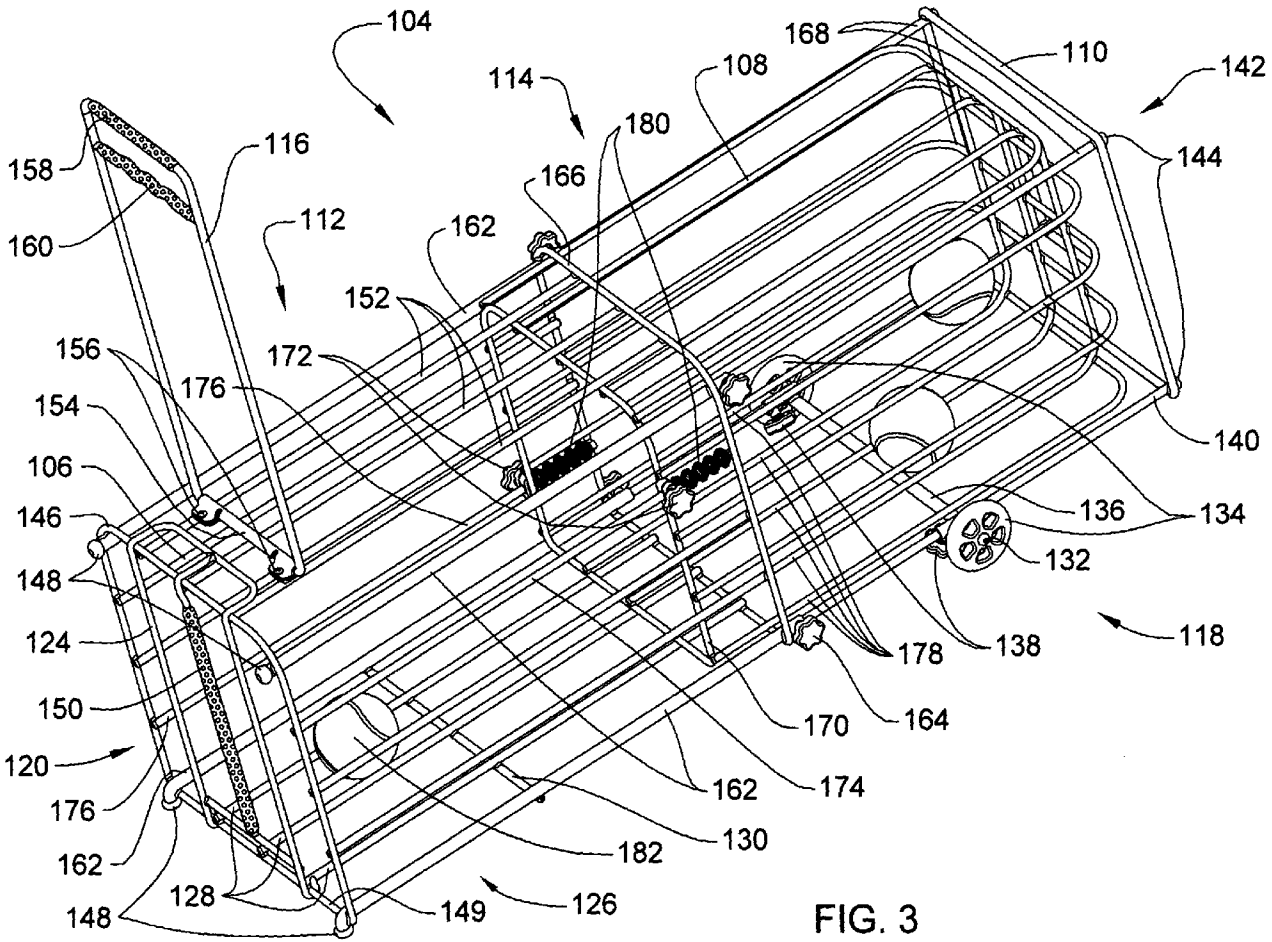
FIG. 3 is a perspective view of a telescopic retriever in a retrieving position.
Figure 4:
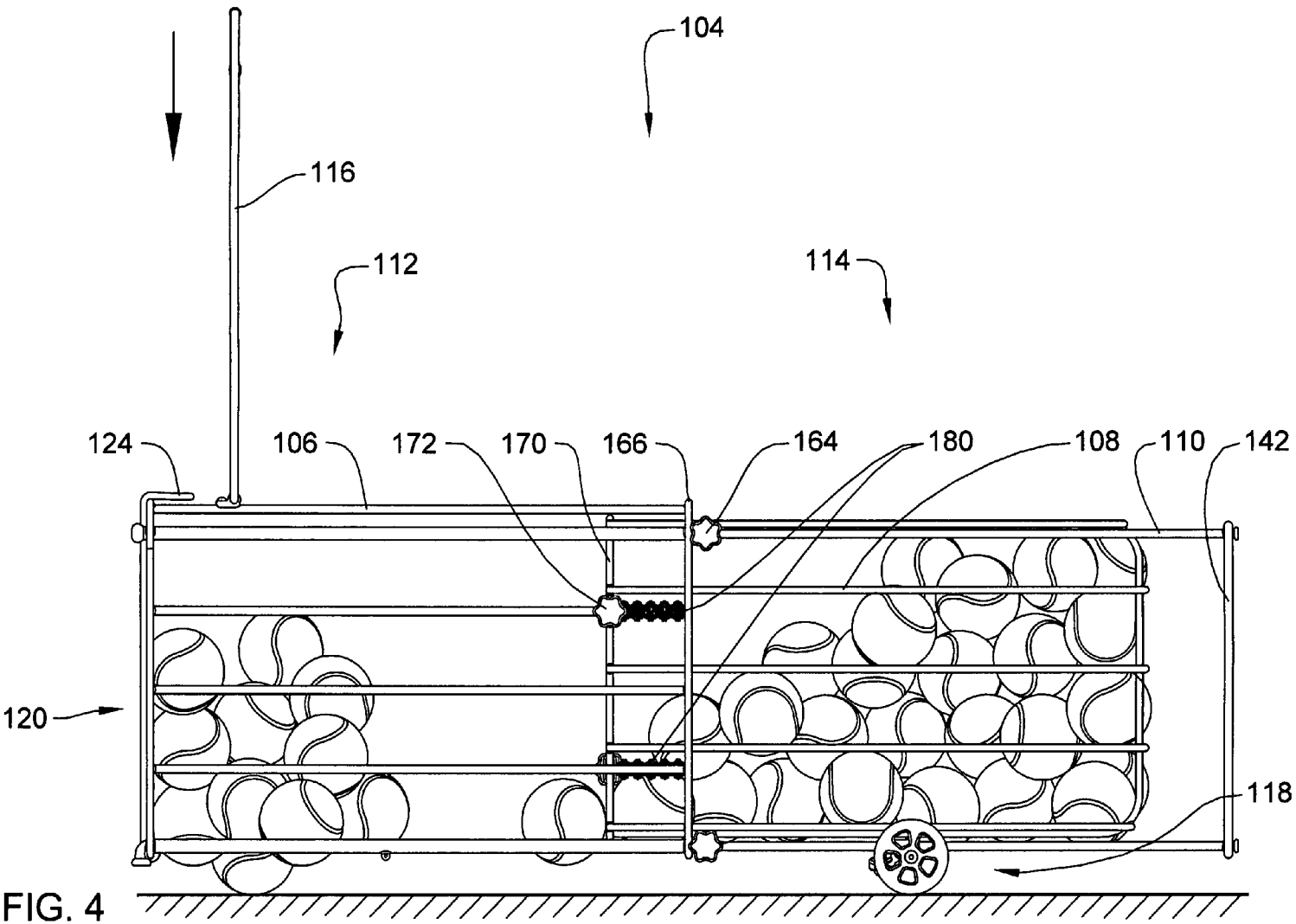
FIG. 4 is a side view of a telescopic retriever in a retrieving position.
Figure 5:
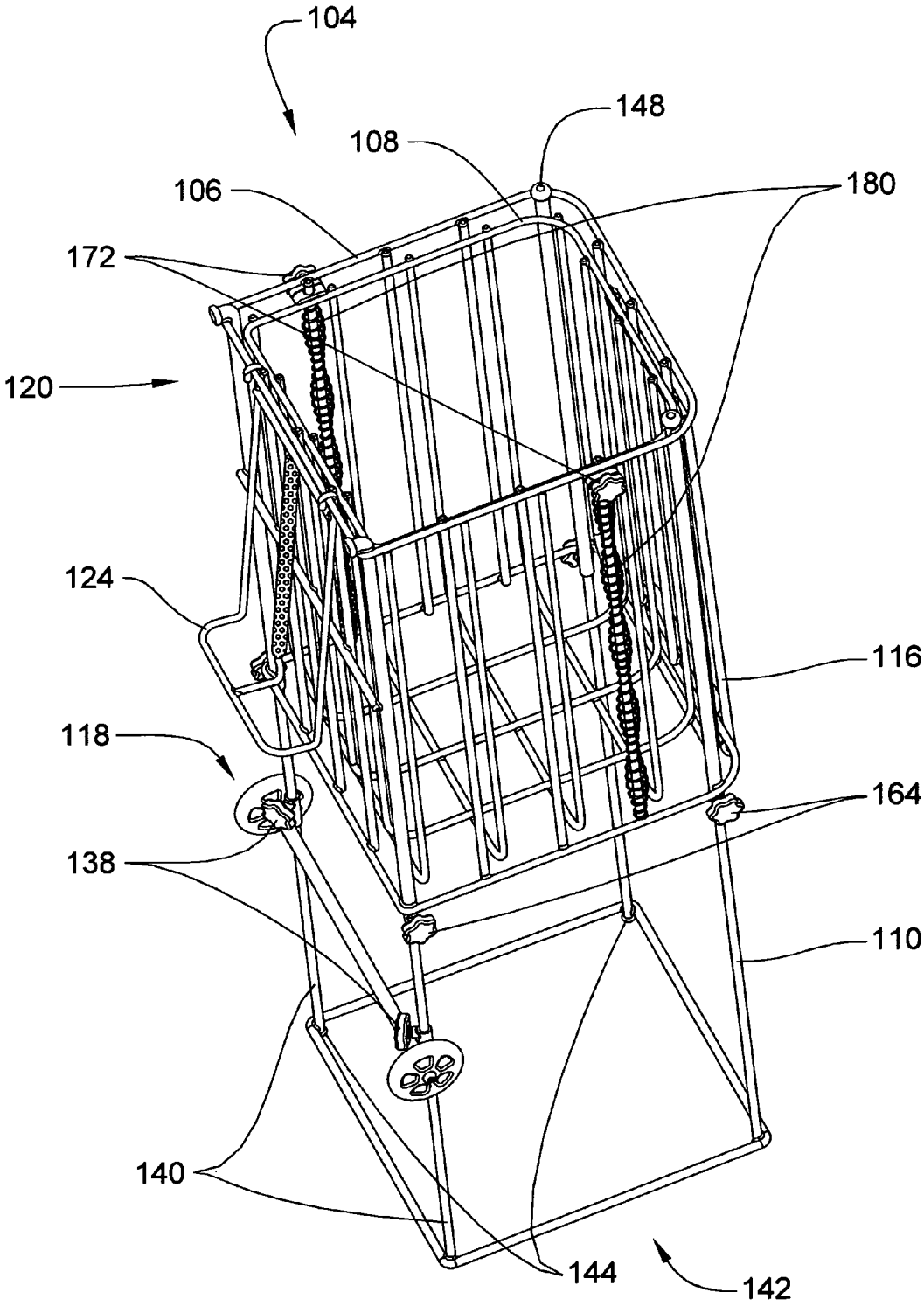
FIG. 5 is a perspective view of a telescopic retriever in a dispensing position.

An alternative embodiment of the portable retriever for collecting and dispensing tennis balls is shown in a retrieving position in FIG. 3 and FIG. 4. It comprises a telescopic container 104 mainly made from steel or stainless steel which includes a solid welded wire basket type body 106, a welded solid wire basket type hopper 108, a welded solid rod frame type stand 110. These components have rectangular shape cross sections. The telescopic container 104 has a front retrieving section 112, a rear collecting section 114, a top handle 116, a pivotable support 118 and front wall rectangular shape dispensing opening 120 with a snap-on cover 124. The front retrieving section 112 contains a retrieving bottom aperture 126 including three parallel rods 128 spaced from each other a distance smaller than the tennis ball diameter, a spacing rod 130 and the top handle 116. The pivotable support 118 is located at the rear collecting section 114 and includes two axes 132 and two wheels 134 coaxially mounted on a carriage 136. The carriage 136 slidably attached by two quick release rod carriage clamps 138 to the stand 110 two bottom rods 140. Wheels 134 are jut out from a telescopic container 104 bottom wall. The telescopic container 104 has an upright vertical dispensing position only and it is illustrated in FIG. 5. A rear wall 142 includes four rear projections 144 for setting the container in an upright vertical dispensing position. A front wall 146, as shown in FIG. 3, comprises four projections 148 to set the container in an upside-down vertical position for the telescopic container 104 adjustments. The snap-on cover 124 is pivotably attached to a front wall rod 149 and includes a middle recessed handle 150. The top handle 116 pivotably attached to three top wall rods 152 by a friction hinge 154 with tension screws 156. The top handle 116 has two rubber coated parallel grip rods 158 and 160 and it is foldable. The body 106 comprises four horizontal tubes 162 at body corners and four quick release rod body clamps 164 mounted at a body rear end 166. Two horizontal bottom tubes 162 are spaced from next to them parallel bottom rods 128 a distance smaller than the tennis ball diameter. Stand 110 contains four horizontal rods, two top rods 168 and two bottom rods 140. Each rod is aligned with one of four body tubes 162. The stand 110 slidably attached to the body 106 by four quick release rod body clamps 164. The hopper 108 has front opening 170 and quick release rod hopper clamps 172. The hopper 108 slidably attached to body side walls rods 174 and 176 by quick release rod hopper clamps 172. Hopper bottom rods 178 spaced from each other a distance smaller than the tennis ball diameter and are aligned with retrieving aperture 126 parallel rods 128 and bottom tubes 162. The telescopic container 104 has at least two compression coil springs 180 installed on the body 106 rods 174 and 176 between body rear end 166 and hopper front opening 170.

Figure 6:
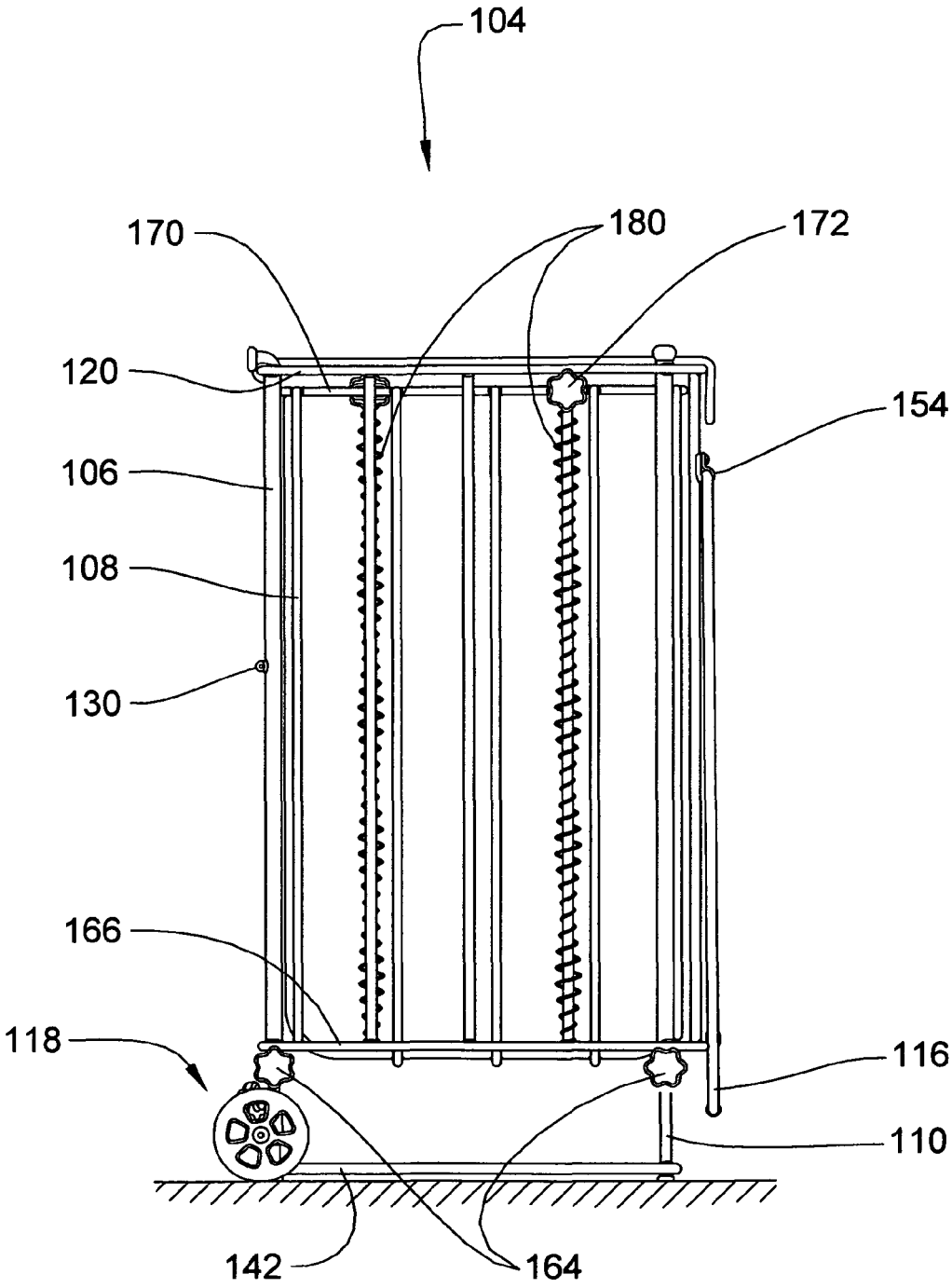
FIG. 6 is a side view of a compacted telescopic retriever.

The alternative embodiment telescopic container 104, as shown in FIG. 3, is structurally and functionally identical to the preferred embodiment solid container 20 of the invention, as shown in FIG. 1. Each embodiment includes a capacity regulating element. As a capacity regulating element the telescopic container 104 has the hopper 108 slidably attached to the container body 106 and the solid container 20 has as a capacity regulating element the partition 76 slidably attached to the container body 22. It is possible to use a hopper for the solid container 20 and a partition for the telescopic container 104 as well. The solid container 20 has two vertical dispensing positions and telescopic container 104 has one vertical dispensing position. Telescopic container 104 compression coil springs 168 may be used to automate a compartment capacity adjustment during balls dispensing procedure by moving up the hoper 108. Compression or extension coil springs could be utilized in the solid container 20 for the same purpose by moving the partition 76 up when the container is in a dispensing position. The carriage 126 is slidably attached to stand 110 bottom rods for repositioning towards the retrieving section 112 to reduce a heavy container lifting force requirement. The preferred embodiment solid container 20 wheels 52 as an option may be coaxially mounted on a carriage which is slidably attached to the solid container 20 bottom wall 54 as well. The telescopic container 104 can be compacted, as shown in FIG. 6, for transportation or storage purposes. To accomplish this task the hopper 108 front opening 170 should be set next to the container dispensing opening 120, the pivotal support 118 should be placed at the stand 110 rear end 142 and the stand 110 rear end 142 has to be positioned next to the body rear end 166.

Figure 7:
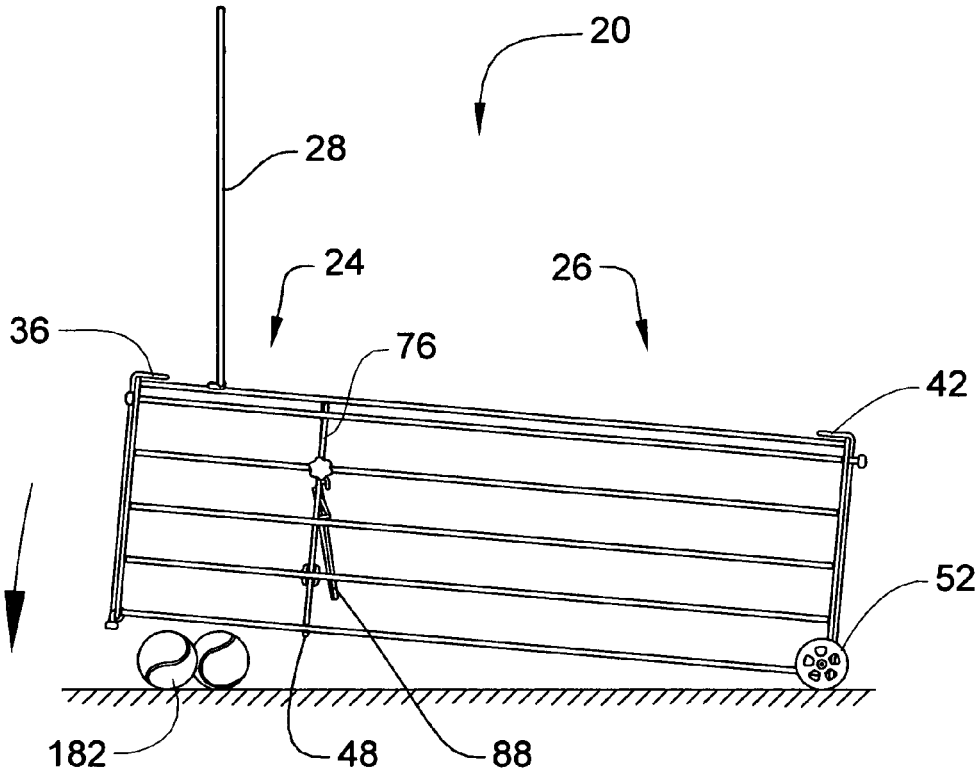
FIG. 7 is a side view of an empty solid retriever with a retrieving bottom aperture above a few balls to be collected.
Figure 8:
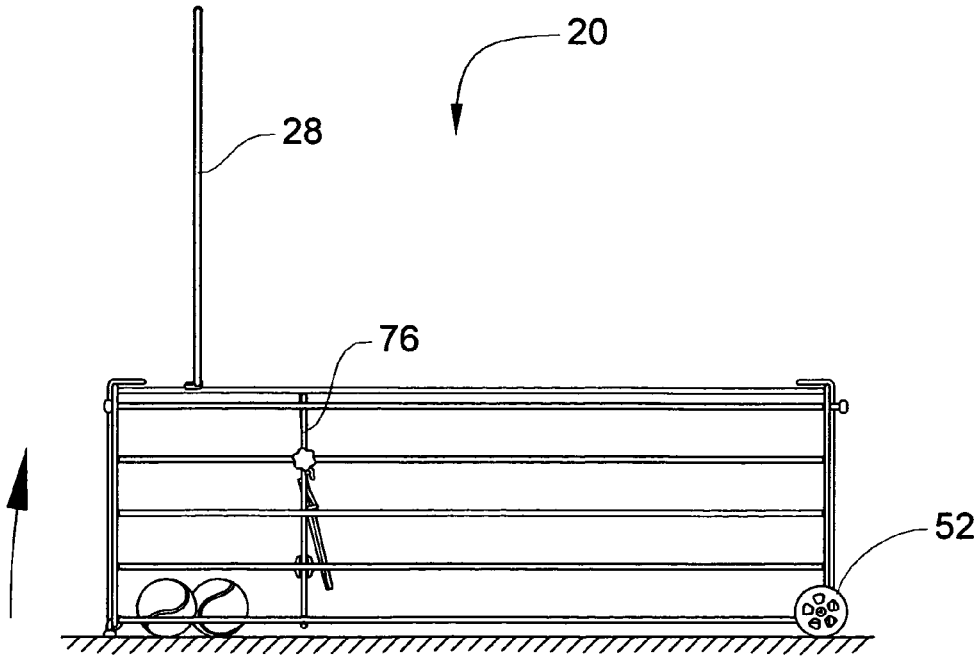
FIG. 8 is a side view of a solid retriever with a few balls pressed against a flat surface entering inside.
Figure 9:
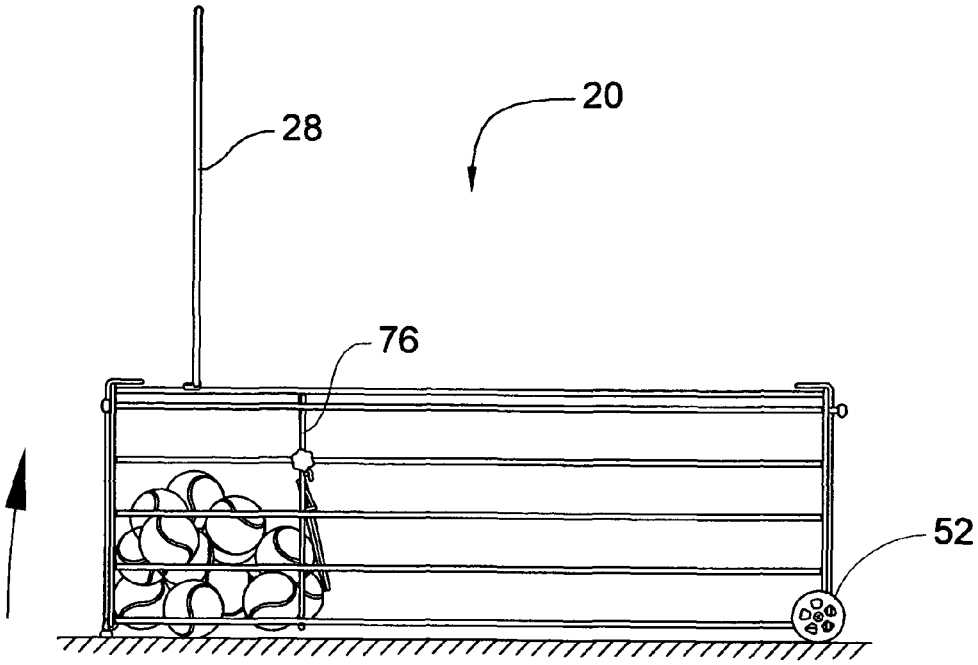
FIG. 9 is a side view of a solid retriever with a substantial group of balls resided in a retrieving section.
Figure 10:
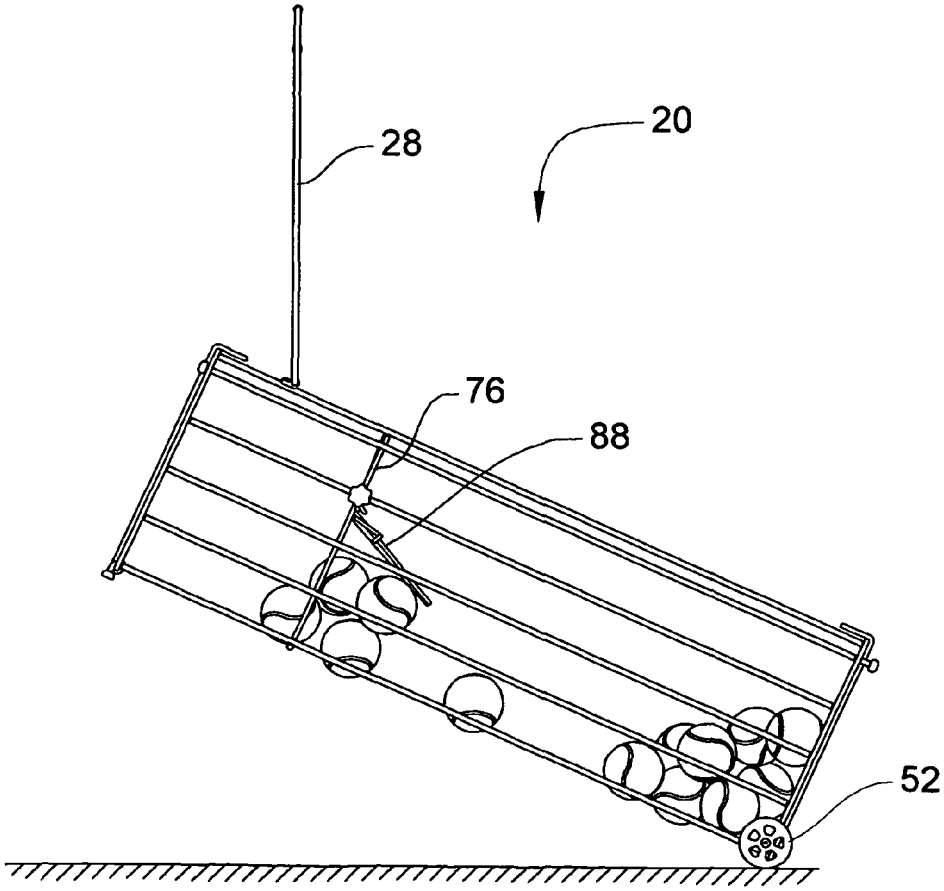
FIG. 10 is a side view of a solid retriever transferring a substantial group of retrieved balls towards a container collecting section.
Figure 11:
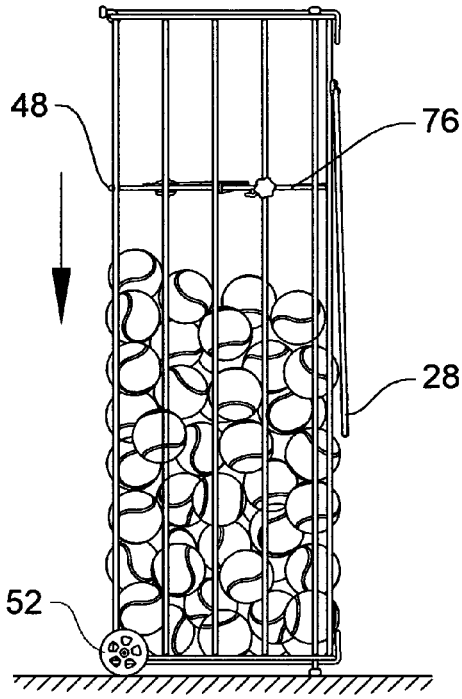
FIG. 11 is a side view of a solid retriever set in an upright vertical dispensing position with a partially filled lower compartment.
Figure 12:
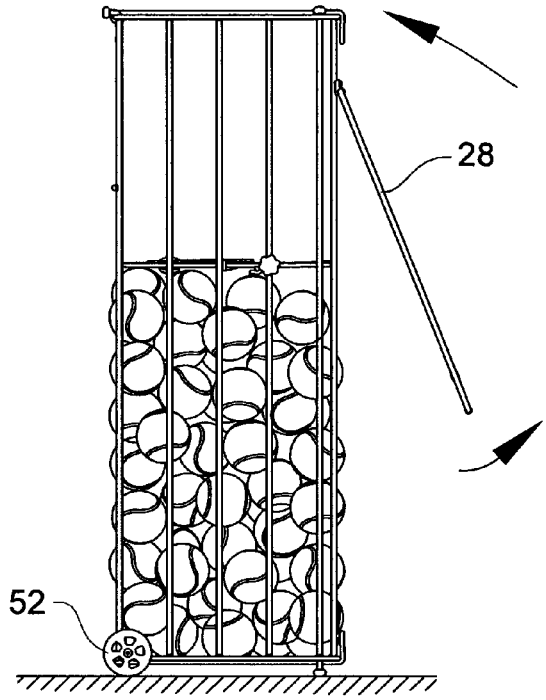
FIG. 12 is a side view of a solid retriever set in an upright vertical dispensing position with a correspondingly adjusted lower compartment capacity.
Figure 13:
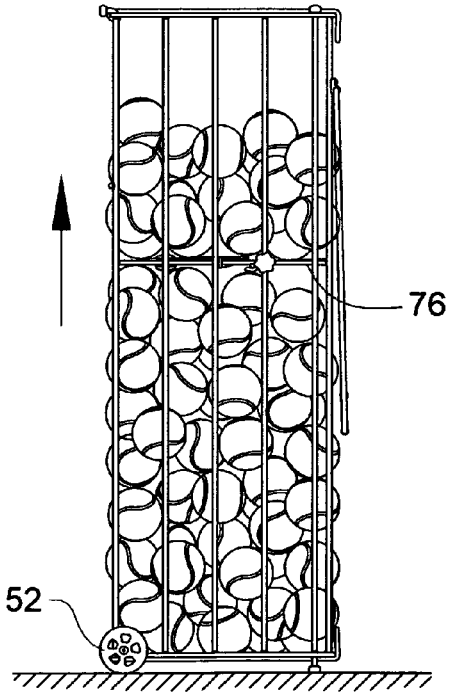
FIG. 13 is a side view of a solid retriever set in an upright dispensing position with a partially filled upper compartment.
Figure 14:
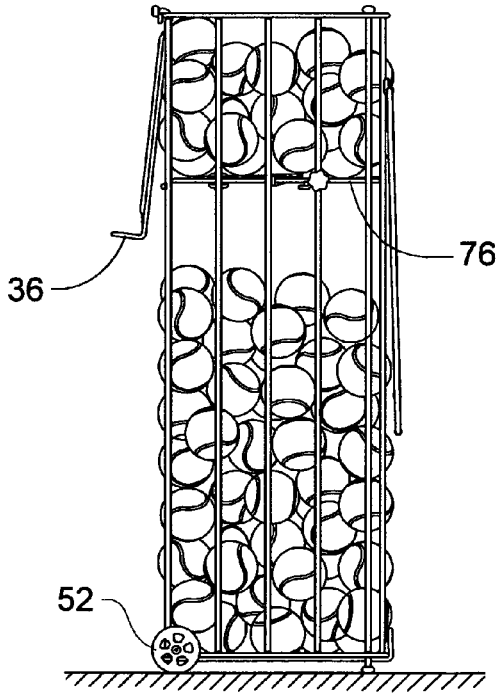
FIG. 14 is a side view of a solid retriever set in an upright dispensing position with a correspondingly adjusted upper compartment capacity.
Figure 15:
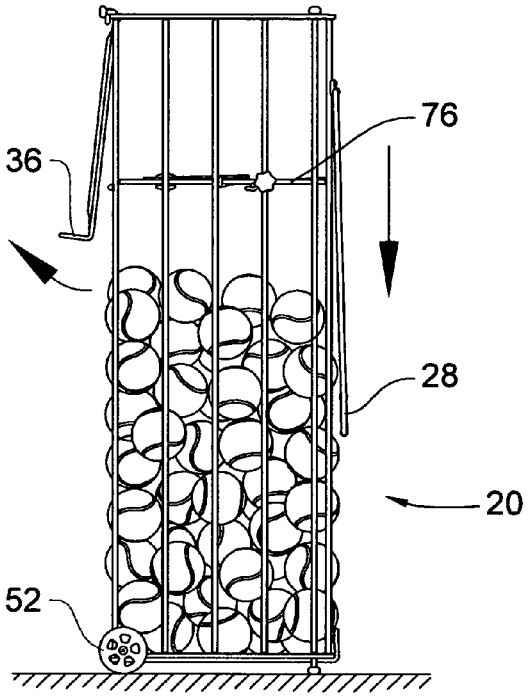
FIG. 15 is a side view of a solid retriever set in an upright dispensing position with an emptied upper compartment.
Figure 16:
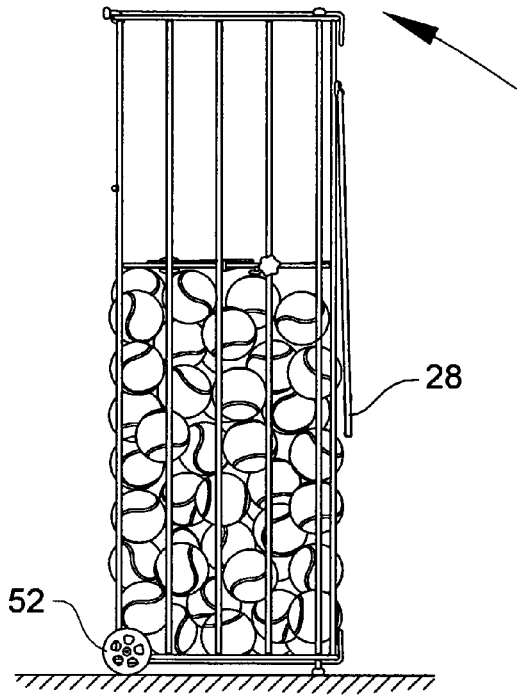
FIG. 16 is a side view of a solid retriever set in an upright dispensing position prepared for flipping over.
Figure 17:
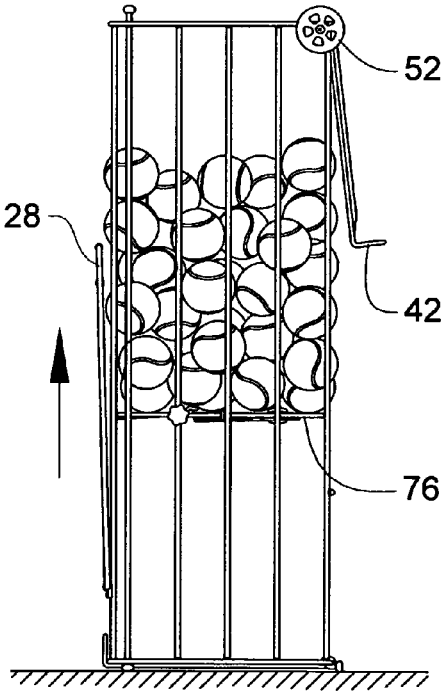
FIG. 17 is a side view of a solid retriever set in an upside down dispensing position when comfortably reachable balls are dispensed.
Figure 18:
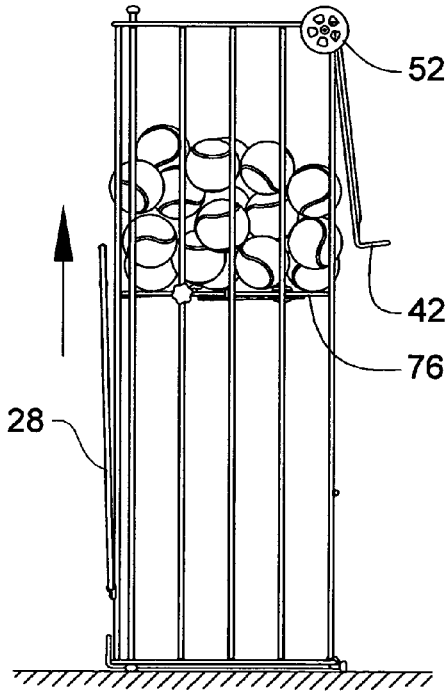
FIG. 18 is a side view of a solid retriever set in an upside down dispensing position with an upper compartment capacity to be reduced one more time.

FIG. 7 through FIG. 18 illustrates consecutive stages of retrieving, collecting and dispensing large amount of tennis balls by the solid container 20. The user begins retrieving process from setting the solid container 20 pivotably supported by wheels 52 in the horizontal retrieving position. The partition 76 located next to the spacing rod 48 and the gate 88 is unlocked. Snap-on covers 36 and 42 are closed and dispensing openings 34 and 40 are blocked. The user moves the solid container 20 towards balls 182 laying on a tennis court surface by the upright oriented top handle 28 slightly lifting the front end. After reaching a balls area the user turns the solid container 20 in horizontal and in vertical planes until the retrieving bottom aperture appears above a ball or a few balls to be collected as shown in FIG. 7. Now the user retrieves a ball or a few balls by pushing the handle 28 down until a ball or a few balls pressed against the flat surface enter into the container as shown in FIG. 8. The user is repeats previous steps until a substantial group of balls is retrieved, as shown in FIG. 9. When a required push down force noticeably increases, the user transfers the retrieved substantial group of balls towards the container collecting section by turning the solid container 20 in vertical plane, as shown in FIG. 10. Balls, descending by the gravity force, open the pivotably attached unlocked gate 88 on their way down. This step is introduced to diminish previously retrieved balls resistance to following balls insertion through the basket bottom grate. At the same time, a lifting force is reduced because retrieved balls are moved closer to the solid container 20 rear end which is supported. Then the user repeats previous steps until chosen balls quantity is retrieved or the container collecting section gets full. After that the user sets the solid container 20 in the upright vertical position, as shown in FIG. 11, locks the gate 88 and reduces the collecting section compartment capacity by repositioning the partition 76 downwards, so it reaches collected balls as shown in FIG. 12. In case the chosen balls quantity is retrieved, the user folds the top handle 28, puts the solid container 20 in the upside-down dispensing vertical position, turns the snap-on cover 42 into open position and dispenses collected balls. In case more balls have to be collected, the user restarts a retrieving process until the front section gets full. Then the user sets the solid container 20 in the upright dispensing position, folds the top handle 28, as shown in FIG. 13, reduces the retrieving section compartment capacity by repositioning the partition 76 upwards, so collected balls contact the cover 36 and then puts the cover 36 into an open position as shown in FIG. 14. The user dispenses comfortably reachable balls from the solid container 20, reduces the retrieving section compartment capacity correspondingly to the volume of balls resided in the retrieving section compartment and repeats previous steps until the chosen balls quantity is dispensed from the solid container 20 as shown in FIG. 15. After that the user reduces the collecting section compartment capacity by repositioning the partition 76 downwards, so it reaches collected balls as shown in FIG. 16, flips over the solid container 20 and sets it in the upside-dawn dispensing position. Then the user dispenses comfortably reachable balls from the container collecting section compartment, as shown in FIG. 17. After that, the user reduces the compartment capacity correspondingly to the volume of balls resided in the collecting section and repeats previous steps until chosen balls quantity is dispensed from the solid container 20, as shown in FIG. 18. To continue the cycle retrieving a large quantity of balls, the user sets the solid container 20 in retrieving position and repeats previously described steps. For retrieving a small number of balls, the user places the partition 76 next to the spacing rod 48, tightens up two clamps 78 knobs, locks the gate 88 and brings the solid container 20 in horizontal position. Then, the user collects a small number of balls in the retrieving section and dispenses balls in upright dispensing position. In this instance, the partition 76 can remain in the same position through a whole cycle. During the retrieving process the user may receive balls from another source by setting the solid container 20 in one of two dispensing positions, opening a snap-on cover appeared on the container top, discharging balls from another source into the container, closing a snap-on cover and setting the container back in the retrieving position.

The user may apply same methods of retrieving, collecting and dispensing tennis balls to the alternative embodiment telescopic container 104 as well. Prior to the retrieving process, the telescopic container's 104 length and pivotable support 118 position may be adjusted by the user in upside down vertical position using body and carriage clamps 164 and 138 correspondingly. FIG. 4 illustrates the horizontally oriented telescopic container 104 with just retrieved substantial group of balls at the front retrieving section and balls transferred earlier into collecting rear section. The telescopic container 104 is set for a large group of balls to be retrieved and the container compartment capacity exceeds this large group of balls volume. The hopper 108 front opening 170 is placed next to the body 106 rear end 166, compression coil springs 180 are compacted, the snap-on cover 124 is closed, blocking the front dispensing opening 120 and the pivotable support 118 is spaced from stand 110 rear end 142. Balls placed in between pivotable support 118 and the hopper 108 rear end 142 become a counterweight which ease holding and lifting the container during the retrieving process. The user will transfer a retrieved substantial group of balls towards the collecting section by lifting up the front of the telescopic container 104. Then, the user repeats filling up the container compartment with balls by retrieving and transferring balls until chosen balls quantity is retrieved or the container becomes full. In case a ball machine has to be refilled, collected balls may be discharged out from the telescopic container 104 by opening the snap-on cover 124 and tilting the container. To dispense collected balls individually, the user sets the telescopic container 104 in upright dispensing position, opens up the snap-on cover 124, loosens two hopper clamps 172 knobs and starts the dispensing process. When the telescopic container 104 is full, the hopper with balls combined gravity force slightly overcomes the two coil springs total tension force. As soon as the user dispenses some comfortably reachable balls from the telescopic container 104, coil springs 180 with the predetermined stiffness will move the hopper 108 up, automatically reducing the container compartment capacity correspondingly to the volume of balls group resided in the compartment. As soon as the user dispenses a few more balls, the springs move the hoper and remaining balls higher until gravity and tension forces are equalized. As a result, the user comfortably reaches balls during the dispensing procedure without spending time for relocating the hopper 108 manually. In FIG. 5, the telescopic container 104 is shown in dispensing position with hopper 108 pushed all the way up by coil springs 180 after all balls have been dispensed. To continue retrieving a large number of balls, the user pushes the hopper 108 by hopper clamps 172 knobs all the way down compacting coil springs 180, tightens up the hopper clamps 172 knobs, closes snap-on cover 124 and brings the telescopic container 104 in the horizontal retrieving position, as shown in FIG. 3. For retrieving a small group of balls, the user just tightens up hopper clamps 172 knobs, closes the snap-on cover 124 and brings the telescopic container 104 in the horizontal retrieving position. In this case, retrieved balls will be pushed through the body bottom aperture 126 parallel rods and aligned with them hoper parallel rods 178 directly into the hopper.

The presented preferred and alternative embodiments should not be interpreted as limiting the scope of this invention. For example, the container dispensing opening can have other shapes such as trapezoidal, circular, etc.; the front retrieving section can contain additional two wheels coaxially mounted at the container bottom wall to ease tennis balls retrieving procedure and to move container in the vertical upside down position. Thus, the scope of the invention should be determined by the appended claims and their legal equivalents.

I claim:

1. A portable retriever for collecting and dispensing tennis balls utilized on a flat surface, said portable retriever comprising:

a container having a dispensing opening, a front wall, a rear wall, a bottom wall with a retrieving bottom aperture including parallel rods spaced from each other a distance smaller than a tennis ball diameter, so as to define a space through which squeezed balls pushed against said flat surface enter and retain in said container, a top handle, a wheeled support, wherein said container has a horizontally elongated body in a front to rear direction comprising a partition which divides an interior of said container into a front retrieving section comprising said front wall and a rear collecting section comprising said rear wall, said partition has a movably attached gate, whereby said retrieving bottom aperture and said top handle are located at said front retrieving section and said wheeled support is placed at said rear collecting section.

2. The retriever of claim 1 wherein said gate is pivotably attached to said partition.

3. The retriever of claim 2 said gate further including a latch.

4. The retriever of claim 1 said partition further including quick release clamps and said partition is slidably attached to said container.

5. The retriever of claim 1 wherein said wheeled support including two wheels coaxially mounted at said bottom wall of said container.

6. The retriever of claim 1 said container further including a friction hinge and said top handle is pivotably attached to said container by said friction hinge.

7. The retriever of claim 1 said front wall further including said dispensing opening and a cover.

8. The retriever of claim 1 said rear wall further including said dispensing opening and a cover.

9. The retriever of claim 1 said top handle further including parallel grip rods.

* * * * *